US008340557B2

(12) United States Patent
Wayman

(10) Patent No.: US 8,340,557 B2
(45) Date of Patent: Dec. 25, 2012

(54) TORSION FLEXIBLE DONOR ROLL DRIVE AND METHOD

(75) Inventor: William H. Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 115 days.

(21) Appl. No.: 12/946,191

(22) Filed: Nov. 15, 2010

(65) Prior Publication Data

US 2012/0121300 A1 May 17, 2012

(51) Int. Cl.
*G03G 15/08* (2006.01)

(52) U.S. Cl. ..... 399/279

(58) Field of Classification Search ..... 399/279; 101/38.1

See application file for complete search history.

(56) References Cited

U.S. PATENT DOCUMENTS

| | | | | |
|---|---|---|---|---|
| 7,512,366 | B1 | 3/2009 | Beachner et al. | |
| 2007/0041747 | A1 * | 2/2007 | Kim et al. | 399/222 |
| 2008/0193159 | A1 * | 8/2008 | Terae et al. | 399/98 |
| 2009/0282991 | A1 * | 11/2009 | Ueno | 101/38.1 |

* cited by examiner

*Primary Examiner* — Walter L Lindsay, Jr.
*Assistant Examiner* — Frederick Wenderoth
(74) *Attorney, Agent, or Firm* — Fay Sharpe LLP

(57) ABSTRACT

A donor roll assembly for a developer unit including a donor roll for delivering toner onto a moving photoconductive member. The donor roll is supported for rotation and has an input shaft, a gear slideably received on the input shaft, and a torsion damper for rotationally coupling the gear to the input shaft of the donor roll for torsion damping. The torsion damper includes a resilient member adapted to deform under torsion to damp speed error (jitter) of a driving component, such as a motor.

16 Claims, 9 Drawing Sheets
(2 of 9 Drawing Sheet(s) Filed in Color)

TORSION FLEXIBLE DONOR ROLL DRIVE AND METHOD

BACKGROUND

This disclosure relates to maintaining print quality in xerographic developer systems. More particularly, the teachings herein are directed to apparatus and methods for driving one or more donor rolls in a developer system.

Generally, the process of electrophotographic printing includes charging a photoconductive member such as a photoconductive belt or drum to a substantially uniform potential to sensitize the photoconductive surface thereof. The charged portion of the photoconductive surface is exposed to a light image from a scanning laser beam, a light emitting diode (LED) source, or other light source. This records an electrostatic latent image on the photoconductive surface. After the electrostatic latent image is recorded on the photoconductive surface, the latent image is developed in a developer system with charged toner. The toner powder image is subsequently transferred to a copy sheet and heated to permanently fuse it to the copy sheet.

The electrophotographic marking process given above can be modified to produce color images. One electrographic marking process, called image-on-image (IOI) processing, superimposes toner powder images of different color toners onto a photoreceptor prior to the transfer on the composite toner powder image onto a substrate, such as paper. While the IOI process provides certain benefits, such as a compact architecture, there are several challenges to its successful implementation. For instance, the viability of printing system concepts, such as IOI processing, require developer systems that do not interact with previously toned images.

In the developer system, two-component and single-component developer materials are commonly used. A typical two-component developer material comprises magnetic carrier granules having toner particles adhering triboelectrically thereto. A single-component developer material typically comprises toner particles. Since several known developer systems such as conventional two component magnetic brush development and single component jumping development interact with the photoconductive surface, a previously toned image will be scavenged by subsequent developer stations if interacting developer systems are used. Thus, for the IOI process, there is a need for a scavengeless or noninteractive developer systems such as the Hybrid Scavengeless Development (HSD).

In scavengeless developer systems such as HSD, developer materials are maintained in a reservoir and conveyed onto the surface of a conventional magnetic brush roll, also referred to as a mag roll, based on a magnetic field necessary to load the mag roll. Toner is conveyed from the surface of the mag roll onto a donor roll. The donor roll is held at an electrical potential difference relative to the mag roll to produce the field necessary to load toner from the surface of the mag roll onto the surface of the donor roll. The toner layer on the donor roll is then disturbed by electric fields from a wire or set of wires to produce and sustain an agitated cloud of toner particles, which are attracted to the latent image to form a toner powder image on the photoconductive surface.

In donor roll based development systems, the donor roll or rolls are typically driven by one or more motors through a gear train. Since any donor roll velocity error, sometimes referred to as speed jitter, can modulate image development and result in print banding, typical developer systems utilize quality servo motors and precise gearsets to drive the donor roll or rolls. While such drive components have been successful in reducing print banding, speed jitter can occur under some conditions resulting in print banding.

While specific embodiments are described, it will be understood that they are not intended to be limiting. For example, even though the example given is a color process employing Image-On-Image technology, the disclosure is applicable to any system having donor rolls, as well as any other roll or element where it is desirable to reduce speed jitter.

These and other objects, advantages and salient features are described in or apparent from the following detailed description of exemplary embodiments.

BRIEF DESCRIPTION

According to one aspect of the present disclosure, a donor roll assembly for a developer unit comprises a donor for delivering toner onto a moving photoconductive member, the donor roll supported for rotation and having an input shaft, a gear slideably received on the input shaft, and a torsion damper for rotationally coupling the gear to the input shaft of the donor roll to provide torsion damping.

The torsion damper can include a pin for interlocking the gear with the input shaft, a first portion of the pin being received in a radial bore of the input shaft, and a second portion of the pin being received in a bore of the gear. The torsion damper can include a resilient member at the interface of the gear and input shaft, the resilient member adapted to permit limited relative rotation between the gear and the input shaft. The pin can include a rigid core at least partially surrounded by the resilient member. The rigid core can be made of metal, for example. The pin can be composed of an elastomer.

In another embodiment, the torsion damper can include a resilient member received in a radial bore in the input shaft, and a rigid pin interlocking the gear and input shaft, a first portion of the rigid pin being supported by the resilient member, and second portion of the pin being received in a bore in the gear. A central portion of the pin can be supported by the resilient member, and opposite end portions of the pin can be received in respective bores in the gear. The bore in the input shaft can be larger in diameter than the bore in the gear, the larger diameter bore in the input shaft adapted to accommodate a generally cylindrical resilient member having a larger diameter than that of the pin. The resilient member and pin can be coaxially aligned.

In yet another embodiment, the pin can be rigid, and a resilient member can at least partially surround the second portion of the pin received in the bore in the gear, respective radial surfaces of the bore adapted to impinge the resilient member to damp torsion. The resilient member can include an o-ring telescoped over an end of the pin.

In still another exemplary embodiment, the torsion damper can include at least one elastomer ring interposed between a radially inner surface of the gear and a radially outer surface of the input shaft, the elastomer being compressed between the respective surfaces of the input shaft and gear. The torsion damper can include a flexible key received in corresponding keyways of the input shaft and gear, and a pin interlocking the gear and input shaft together for rotation, the pin being received in an elongated bore in the gear, the elongated bore permitting limited relative rotation between the gear and the input shaft, said flexible key damping said limited relative movement. A motor having an output shaft can be drivingly connected to said gear for rotating the donor roll. A developer unit including a donor roll assembly as set forth above can also be provided.

In accordance with another aspect, a method of reducing speed errors in a driven donor roll of a developer unit comprises the steps of rotationally interlocking a driven gear to an input shaft of a donor roll using a torsion damper, and driving the donor roll with a motor having an output shaft drivingly connected to the driven gear.

BRIEF DESCRIPTION OF THE DRAWINGS

The patent or application file contains at least one drawing executed in color. Copies of this patent or patent application publication with color drawings will be provided by the Office upon request and payment of the necessary fee.

Exemplary embodiments will be described with reference to the drawings, wherein like numerals represent like parts, and wherein.

DETAILED DESCRIPTION

Figure 1:
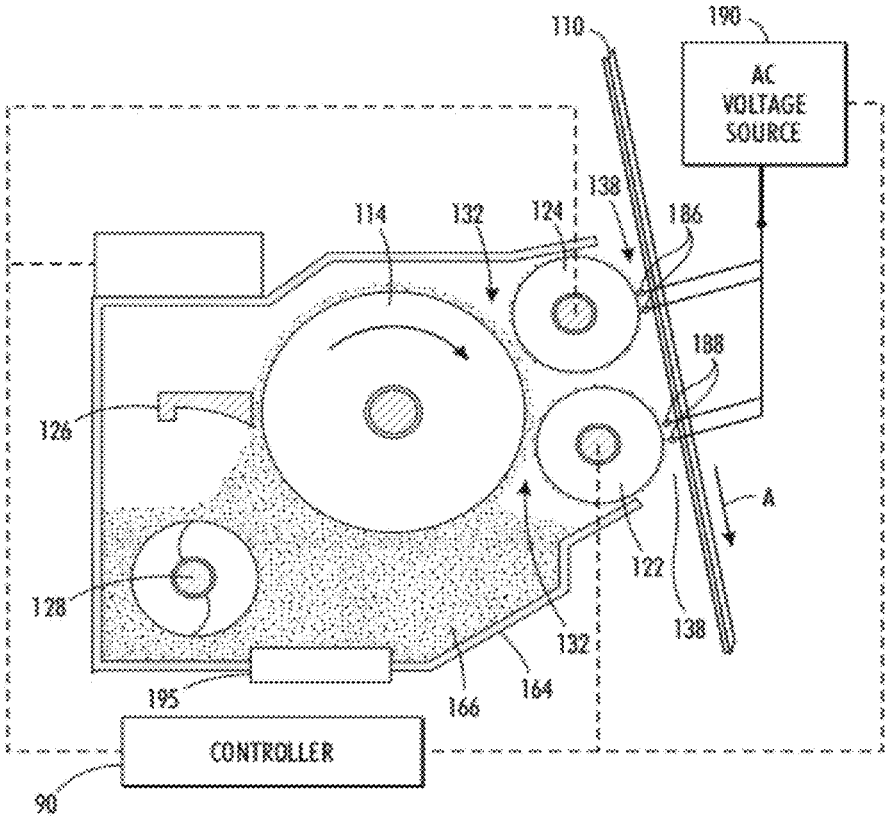
FIG. 1 PRIOR ART
FIG. 1 is side sectional view of a conventional embodiment of a scavengeless developer system.
Figure 2:
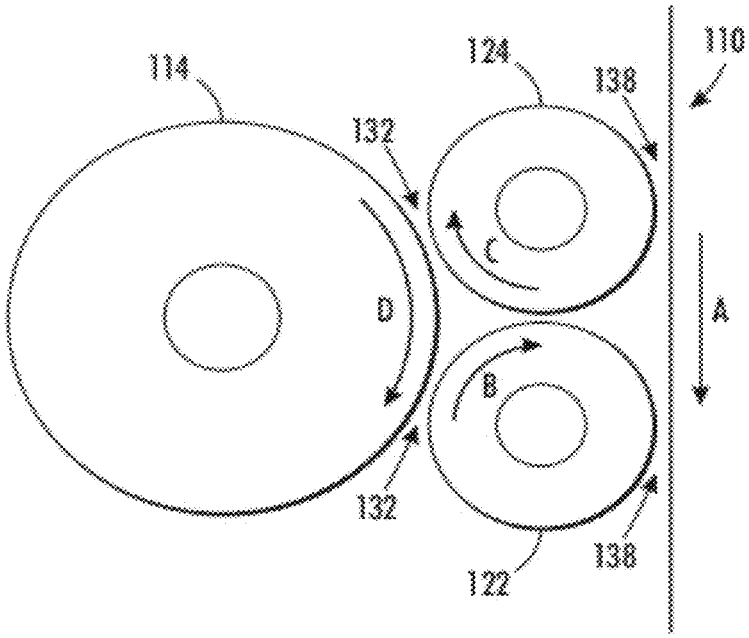
FIG. 2 is a side view of a conventional embodiment of a scavengeless developer system.

Referring now to FIGS. 1 and 2, there are shown details of a scavengeless developer apparatus known in the art. The apparatus comprises a developer housing having a reservoir 164 containing developer material 166. The developer material is of the two component type, meaning that it comprises conductive carrier granules and toner particles. The reservoir 164 includes one or more augers 128, which are rotatably mounted in the reservoir chamber. The augers 128 serve to transport and to agitate the developer material 166 within the reservoir 164 and encourage the toner to charge and adhere triboelectrically to the carrier granules.

The developer apparatus has a single magnetic brush roll, referred to as a mag roll 114, that transports developer material from the reservoir 164 to loading nips 132 of a pair of donor rolls 122 and 124. Mag rolls 114 are well known, so the construction of a mag roll 114 need not be described in further detail.

The mag roll 114 comprises a rotatable tubular housing within which is located a stationary magnetic cylinder having a plurality of magnetic poles arranged around its surface. The carrier granules of the developer material are magnetic, and as the tubular housing of the mag roll 114 rotates, the granules (with toner particles adhering triboelectrically thereto) are attracted to the mag roll 114 and are conveyed to the donor roll loading nips 132. A trim blade 126, also referred to as a metering blade or a trim, removes excess developer material from the mag roll 114 and ensures an even depth of coverage with developer material before arrival at the first donor roll loading nip 132 proximate the upper positioned donor roll 124. At each of the donor roll loading nips 132, toner particles are transferred from the mag roll 114 to the respective donor rolls 122 and 124.

Each donor roll 122 and 124 transports the toner to a respective developer zone, also referred to as a developer nip 138 through which the photoconductive belt 110 passes. Transfer of toner from the mag roll 124 to the donor rolls 122 and 124 can be encouraged by, for example, the application of a suitable D.C. electrical bias to the mag roll 114 and/or donor rolls 122 and 124. The D.C. bias establishes an electrostatic field between the mag roll 114 and donor rolls 122 and 124, which causes toner to be attracted to the donor rolls 122 and 124 from the carrier granules on the mag roll 114.

The carrier granules and any toner particles that remain on the mag roll 114 are returned to the reservoir 164 as the mag roll 114 continues to rotate. The relative amounts of toner transferred from the mag roll 114 to the donor rolls 122 and 124 can be adjusted, for example by: applying different bias voltages, including AC voltages, to the donor rolls 122 and 124; adjusting the mag roll to donor roll spacing; adjusting the strength and shape of the magnetic field at the loading nips 132 and, as discussed above, adjusting the rotational speeds of the mag roll 114 and/or donor rolls 122 and 124.

At each of the developer nips 138, toner is transferred from the respective donor rolls 122 and 124 to the latent image on the photoconductive belt 110 to form a toner powder image on the latter.

In FIG. 1, at the developer nips 138, electrode wires 186 and 188 are disposed in the space between each donor roll 122 and 124 and the photoconductive belt 110. For each donor roll 122 and 124, a respective pair of electrode wires 186 and 188 extend in a direction substantially parallel to the longitudinal axis of the donor rolls 122 and 124. The electrode wires 186 and 188 are closely spaced from the respective donor rolls 122 and 124. The ends of the electrode wires 186 and 188 are attached so that they are slightly above a tangent to the surface, including the toner layer, of the donor rolls 122 and 124. An alternating electrical bias is applied to the electrode wires 186 and 188 by an AC voltage source. When a voltage difference exists between the wires 186 and 188 and donor rolls 122 and 124, the electrostatic attraction attracts the wires to the surface of the toner layer.

The applied AC voltage establishes an alternating electrostatic field between each pair of electrode wires 186 and 188 and the respective donor rolls 122 and 124, which is effective in detaching toner from the surface of the donor rolls 122 and 124 and forming a toner cloud about the electrode wires 186 and 188, the height of the cloud being such as not to be substantially in contact with the photoconductive belt 110. A DC and AC bias supply (not shown) applied to each donor roll 122 and 124 establishes electrostatic fields between the photoconductive belt 110 and donor rolls 122 and 124 for attracting the detached toner from the clouds surrounding the electrode wires 186 and 188 to the latent image recorded on the photoconductive surface of the photoconductive belt 110.

As successive electrostatic latent images are developed, the toner within the developer material is depleted. A toner dispenser (not shown) stores a supply of toner. The toner dispenser is in communication with reservoir 164 and, as the concentration of toner particles in the developer material is decreased, fresh toner particles are furnished to the developer material in the reservoir 164. The augers 128 in the reservoir chamber mix the fresh toner particles with the remaining developer material so that the resultant developer material therein is substantially uniform. In this way, a substantially constant amount of toner is in the reservoir 164 with the toner having a constant charge.

In the conventional arrangement shown in FIG. 2, the donor rolls 122 and 124 and the mag roll 114 are shown to be rotated in the "against" direction of motion. The donor rolls 122 and 124 and the photoconductive belt 110 are shown to be moving in the "same" direction of motion. Although not seen in FIG. 1 or 2, the donor rolls 122 and 124 are typically driven by one or more servo motors through a gear train. In conventional systems, the gear train includes a gear rigidly fixed to an input shaft of the donor roll. As will be appreciated, the scavengeless developer apparatus just described is exemplary in nature and it will be understood that aspects of the present disclosure can be applied to virtually any developer apparatus and thus is not limited to the developer apparatus previously described.

Figure 3:
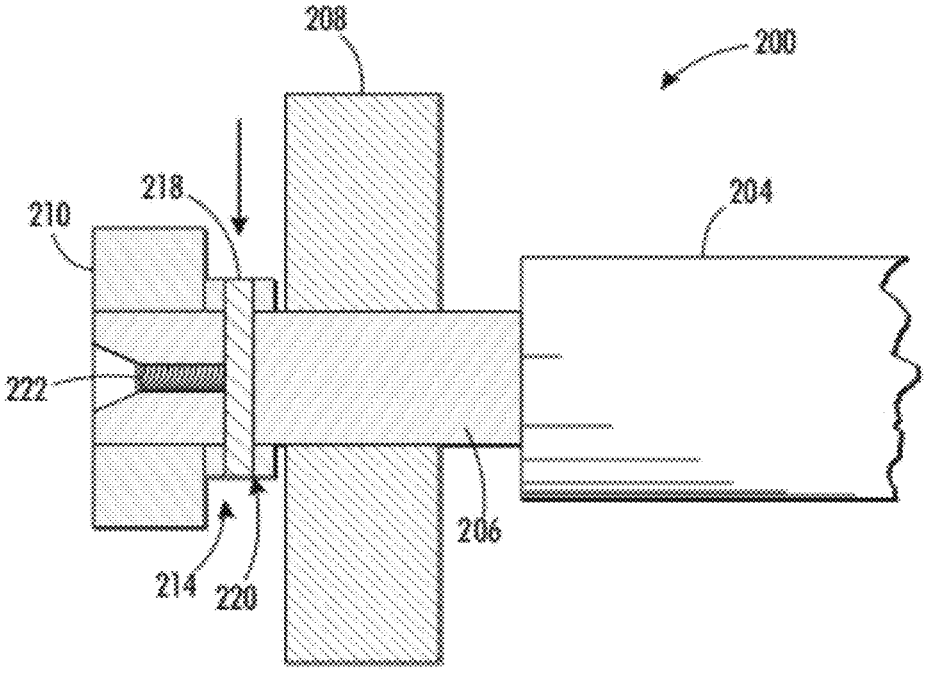
FIG. 3 is a schematic cross-sectional representation of a donor roll assembly including a torsion damper in accordance with the present disclosure.

Turning now to FIGS. 3-12, and initially to FIG. 3, a portion of an exemplary donor roll assembly in accordance with the present disclosure is illustrated and identified generally by reference numeral 200. The donor roll assembly 200 generally includes a donor roll 204 for delivering toner onto a moving photoconductive member (not shown). The donor roll 204 includes an input shaft 206 that is supported for rotation by a donor bearing 208. Donor bearing 208 may be any suitable type of bearing, such as a conventional ball bearing assembly or the like. A distal end of the input shaft 206 includes a gear 210 slidably received over the end of the input shaft 206. A torsion damper 214, which in this embodiment is in the form of a flexible pin 218, rotationally couples the gear 210 to the input shaft 206 and damps torsional movement of the gear 210 relative to the input shaft 206.

In the illustrated embodiment, the flexible pin 218 is in the form of a tubular elastomer element having a central portion thereof received in a radial through bore 220 in the input shaft 206. Opposite end portions of the pin 218 are received in corresponding bores of the gear 210. A set screw 222 retains the pin 218 in a centered position as illustrated.

As noted, the gear 210 is slip fit over the input shaft 206. The flexible (resilient) pin transmits torque applied to the gear 210 to the input shaft 206. The resilient nature of the pin 218 permits limited relative rotation between the gear 210 and the input shaft 206, thus serving to damp torsion and thereby smooth rotation of the donor roll 204. Damping grease can be used at the interface of the gear 210 and input shaft 206 to further damp torsion and/or add additional coupling between the gear and shaft. As will be appreciated, various damping stiffness grades of grease are commercially available for tuning the level of viscous damping.

Donor rolls can weigh approximately 2.5 pounds or more. Because of this mass, they tend to act as a flywheel and higher frequencies of speed error are generally attenuated by the moment of inertia of the roll. For lower frequencies of speed error, the illustrated torsion damper 214 is ineffective for decoupling the speed error from the motion of the donor roll 204. However the speed error of interest is usually from the high frequency of the gear mesh and is effectively damped by torsion damper 214. The torsion damper 214 damps fluctuations in rotational input (speed error) that may be caused by, for example, gear profile error, motor pinion error and/or drive vibration.

Figure 4:
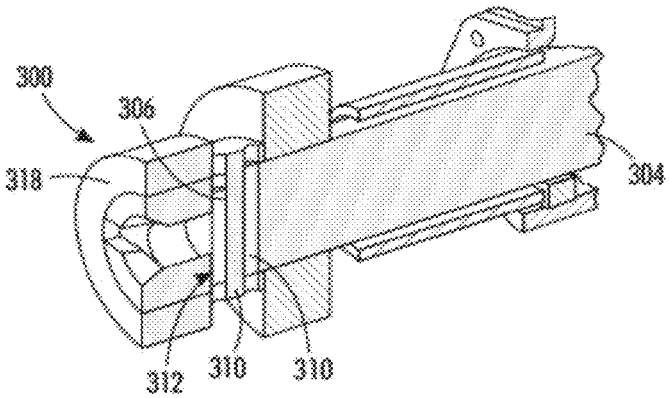
FIG. 4 is a schematic cross-sectional view of another exemplary donor roll assembly including a torsion damper in accordance with the present disclosure.
Figure 5:
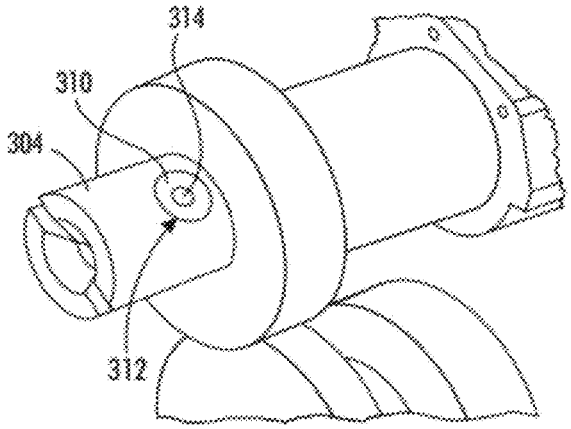
FIG. 5 is a perspective view of the donor roll assembly of FIG. 4 in a partially assembled state prior to installation of the gear.
Figure 6:
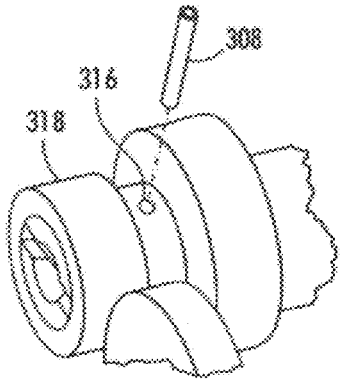
FIG. 6 is a perspective view of the donor roll assembly of FIG. 4 in a partially assembled state after installation of the gear.

Turning now to FIGS. 4-6, another exemplary donor roll assembly 300 including a torsion damper is illustrated. In FIG. 4, which is a cross-sectional view taken axially through the center of a donor roll input shaft 304, the torsion damper is similar to the torsion damper of FIG. 3 except that the torsion damper in this embodiment is in the form of a pin 306 having a rigid core 308 that is at least partially surrounded by a resilient member 310. The resilient member 310 is received in a radial through-bore 312 of the input shaft 304, as seen in FIG. 4. The resilient member 310 includes an axial bore 314 extending therethrough for receiving the rigid core 308. Once installed, the rigid core 308 is received in corresponding bores 316 in a collar 317 of a gear 318, whereas a central portion of the rigid core 308 is supported by the resilient member 310.

To assemble the torsion damper and secure the gear 318 to the end of the input shaft, the resilient member 310 is first inserted into the radial through-bore 312 in the input shaft 304 as shown in FIG. 5. The gear 318 is then telescoped over the end of the input shaft 304 into a position where the respective bores 316 in the gear 318 are aligned with the axially extending bore 314 of the resilient member 310. The rigid core 308, which may be a metal pin or the like, is then inserted into one of the bores 316 and through the axial bore 314 of the resilient member 310 until it is seated in the opposite bore 316 in a collar 317 of the gear 318. It will be appreciated that the rigid core 308 can be sized to be friction fit within the bores 316 in the collar 317 of the gear 318 in order to retain the rigid core in the position shown in FIG. 4.

In operation, the torsion damper of FIGS. 4-6 rotationally interlocks the gear 318 with the input shaft 304 and functions to damp torsion (speed error) by deflection/deformation of the resilient member 310 within the radially extending through-bore 312 of the input shaft 304. As will be appreciated, relative rotation between the gear 318 and the input shaft 304 will cause a twisting of the rigid core 308 which will be opposed through deformation of the resilient member 310. In this manner, speed error from the drive train and/or drive source can be decoupled from the donor roll.

Figure 7:
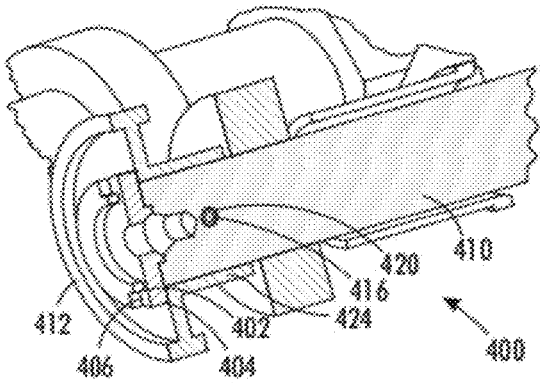
FIG. 7 is perspective cross-sectional view of another exemplary embodiment of a donor roll assembly including a torsion damper.
Figure 8:
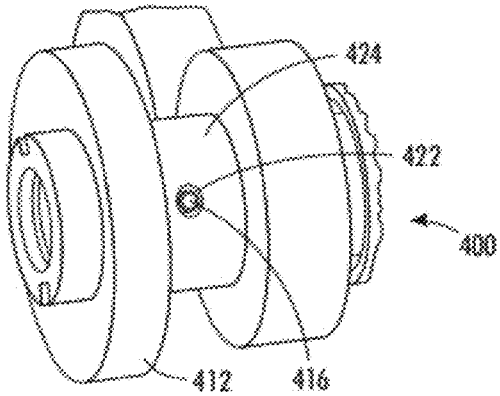
FIG. 8 is a perspective view of the donor roll assembly of FIG. 7.
Figure 9:
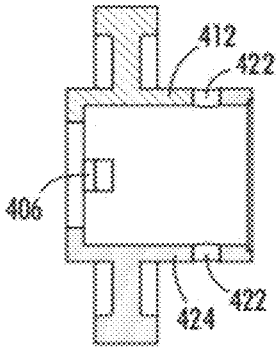
FIG. 9 is a cross-sectional view of the gear of the donor roll assembly of FIGS. 7 and 8.

Turning to FIGS. 7-9, yet another embodiment of a donor roll assembly 400 including a torsion damper is illustrated. In this embodiment, the torsion damper includes a flexible key 402 that is received in corresponding keyways 404 and 406 of an input shaft 410 and gear 412, respectively. In this regard, the input shaft 410 has, on an axial end face thereof, a keyway 404 formed therein that interlocks the flexible key 402 to the input shaft. A corresponding keyway 406 is formed in the gear 412 to interlock the gear 412 to the flexible key 402. As will be appreciated, when assembled on the input shaft 410, the gear 412 is rotationally coupled with input shaft 412 by the flexible key 404.

To secure the gear 412 to the input shaft 410 and to limit the extent of relative axial rotation between the gear 412 and the input shaft 410, a rigid pin 416 is installed in a radial through-bore 420 of the input shaft 410 and received in corresponding bores 422 in a collar 424 of the gear 412. As illustrated in the drawings, the central portion of the pin 416 is closely received within the radial through-bore 420 in the input shaft 410 whereas the outer ends of the pin 416 are received in elongated bores 422 in the collar 424 resembling slots. These elongated bores 422 permit relative rotation between the gear 412 and the input shaft 410 while also limiting the total relative rotation between the two components. The circumferential dimension of the elongated bores 422 can be chosen to provide a maximum limit of relative rotation. In operation, the torsion damper in FIGS. 7-9 damps speed input error through deflection of the flexible key.

Figure 10:
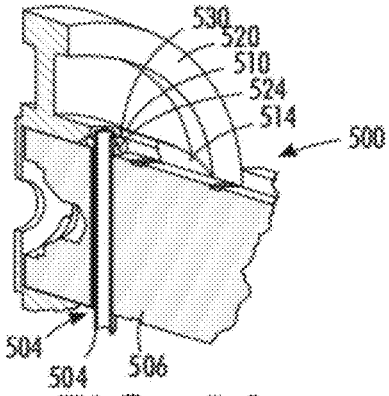
FIG. 10 is a perspective cross-sectional view of another exemplary embodiment of a donor roll assembly including a torsion damper in accordance with the present disclosure.
Figure 11:
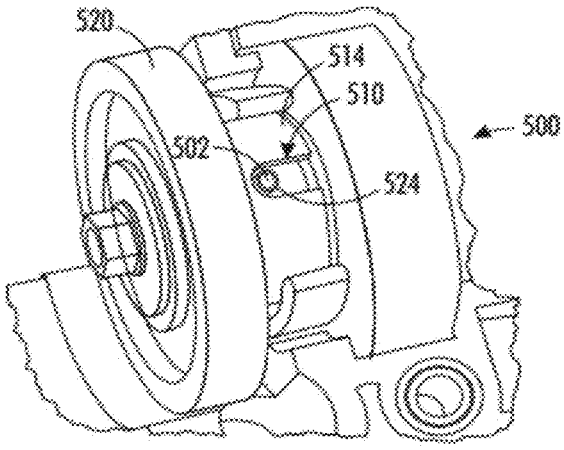
FIG. 11 is a perspective view of the donor roll assembly of FIG. 10.
Figure 12:
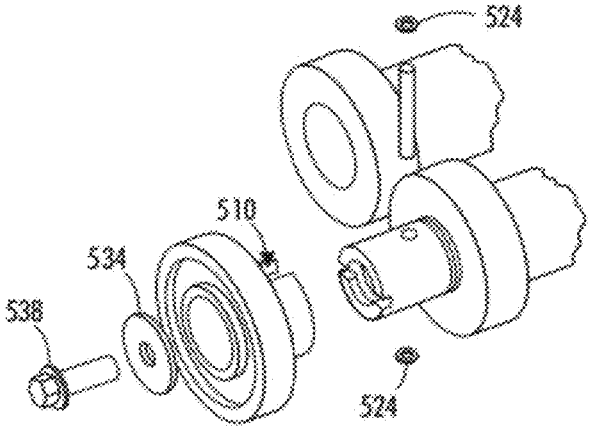
FIG. 12 is an exploded view illustrating the components of the donor roll assembly of FIGS. 10 and 11.

Turning now to FIGS. 10-12, yet another exemplary embodiment of a donor roll assembly 500 including a torsion damper is illustrated. In this embodiment, the donor roll assembly 500 includes a rigid pin 502 received in a through-bore 504 in the input shaft 506. Opposite ends of the rigid pin 502 are received in corresponding bores 510 in a collar 514 of a gear 520. As best seen in FIG. 11, the bores 510 in the collar 514 of the gear 520 extend axially and are open to an axial end face of the collar 514 of the gear 520 in order to permit the gear 520 to be telescoped over an end of the input shaft 506 while the rigid pin 502 is installed in the through bore 504 of the input shaft 506. The bores 510 in the collar 514 of the gear 520 are sized such that a resilient member, in this embodiment a resilient o-ring 524, can be installed over the opposing ends of the rigid pin 502. Respective radial surfaces 530 of each bore 510 are adapted to impinge on the o-ring elements 524 during relative rotation between the gear 520 and the input shaft 506. Deformation of the o-rings thereby serves to damp torsion. A washer 534 and a screw 538 are provided for securing the gear 520 to the end of the input shaft 506.

FIG. 12 illustrates an exploded view of the donor roll assembly 500 wherein it can be seen that assembly of the gear 520 to the input shaft 506 includes inserting the pin 502 into the radial through-bore 504 of the input shaft 506, installing first and second o-rings 524 on the opposing ends of the pin 502 protruding from the input shaft 506, sliding the gear 520 onto the input shaft 506 such that the opposing ends of the pin 502 are received within the bores 510 in the gear collar 514, and securing the gear 520 to the input shaft 506 with the washer 534 and screw 538.

Figure 13:
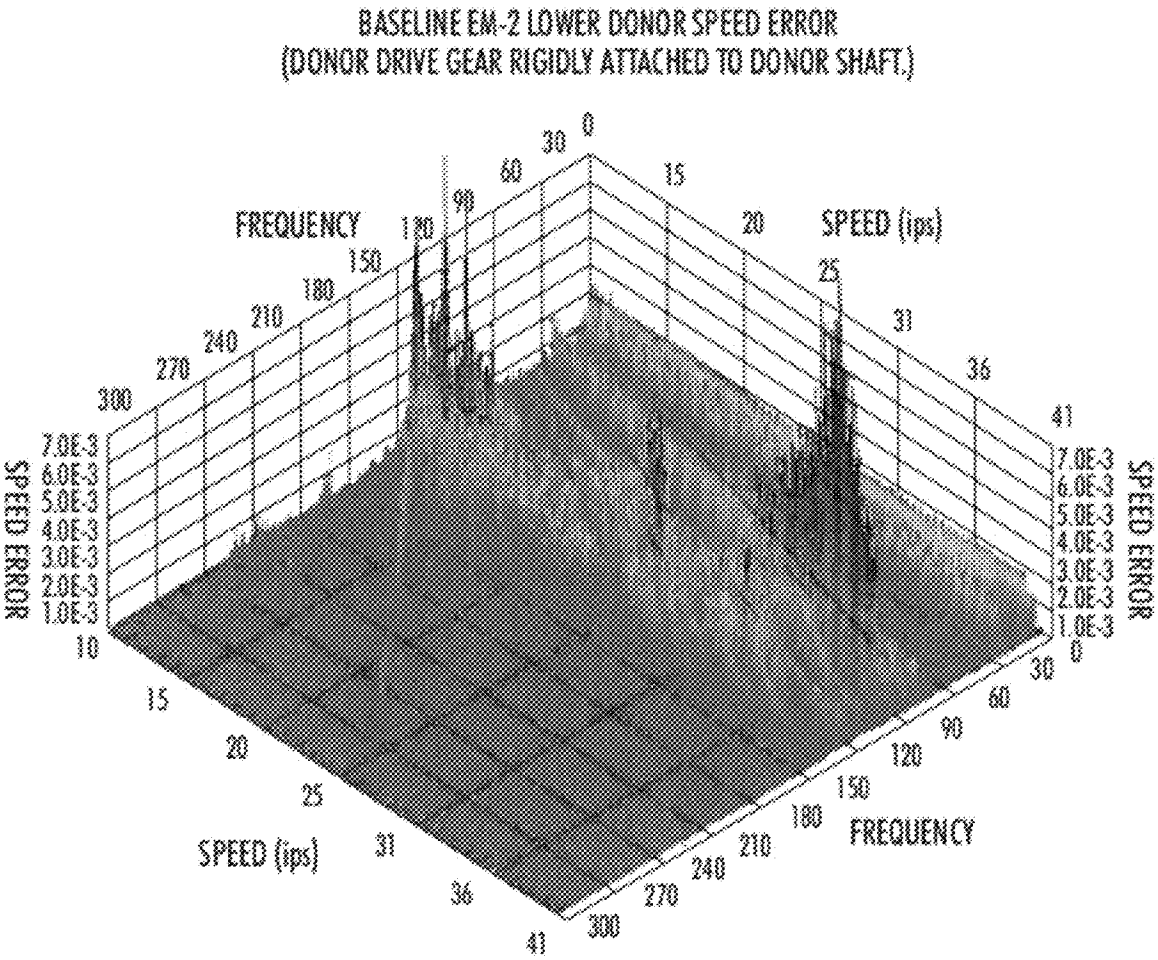
FIGS. 13-16 illustrate comparative test results of a conventional donor roll assembly and a donor roll assembly in accordance with the present disclosure.
Figure 14:
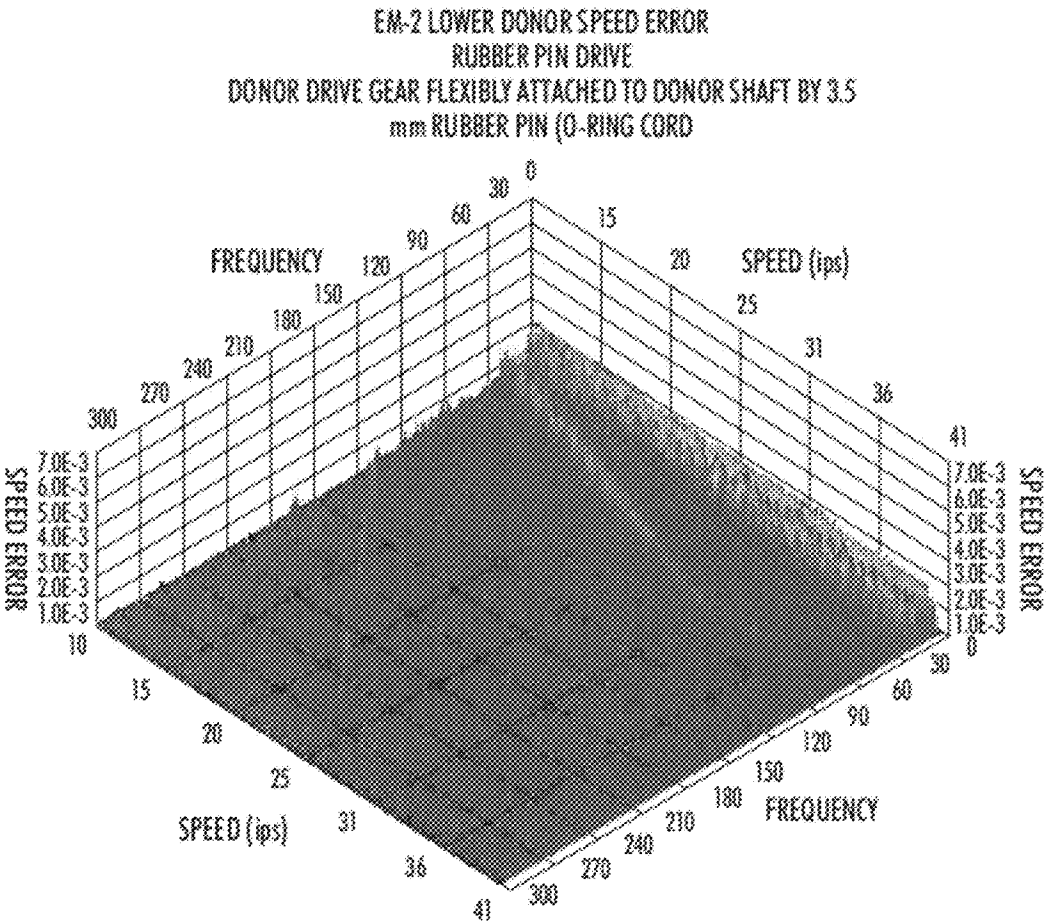

Referring now to FIGS. 13 and 14, the advantage of a donor roll assembly in accordance with the present disclosure is illustrated in graphical form. The measurements were obtained using an encoder with an attached wheel riding on the surface of the donor roll. The encoder frequency (speed) signal was converted by a Frequency to Voltage circuit to an analog voltage proportional to donor roll speed. This analog speed was sampled and processed with a Fast Fourier Transform (FFT) algorithm. The FFT output provides a speed error vs. frequency plot. In the testing, a speed series is run with an FFT generated for each speed. These multiple FFT's are combined to generate the 3D plot showing the speed error as a function of speed and frequency.

FIG. 13 illustrates the results for a conventional donor roll assembly having a fixed (e.g., rigid) connection between the donor roll input shaft and gear. As will be appreciated, the graph illustrates significant speed error in the 60 to 120 Hz range. This speed error is likely intensified around the 60 to 120 Hz range due to donor drive train torsional resonance.

FIG. 14 illustrates the results for a donor roll assembly in accordance with the present disclosure having a torsion damper. A dramatic reduction in the speed error is noted in the 60 to 120 Hz range. Adding torque flexure to the donor drive gear provides torsional decoupling of drive noise and thus effectively reduces or eliminates drive train torsional resonance. In this example, the donor roll shaft as grooved to accept two o-rings, with the gear installed over the O-rings.

Figure 15:
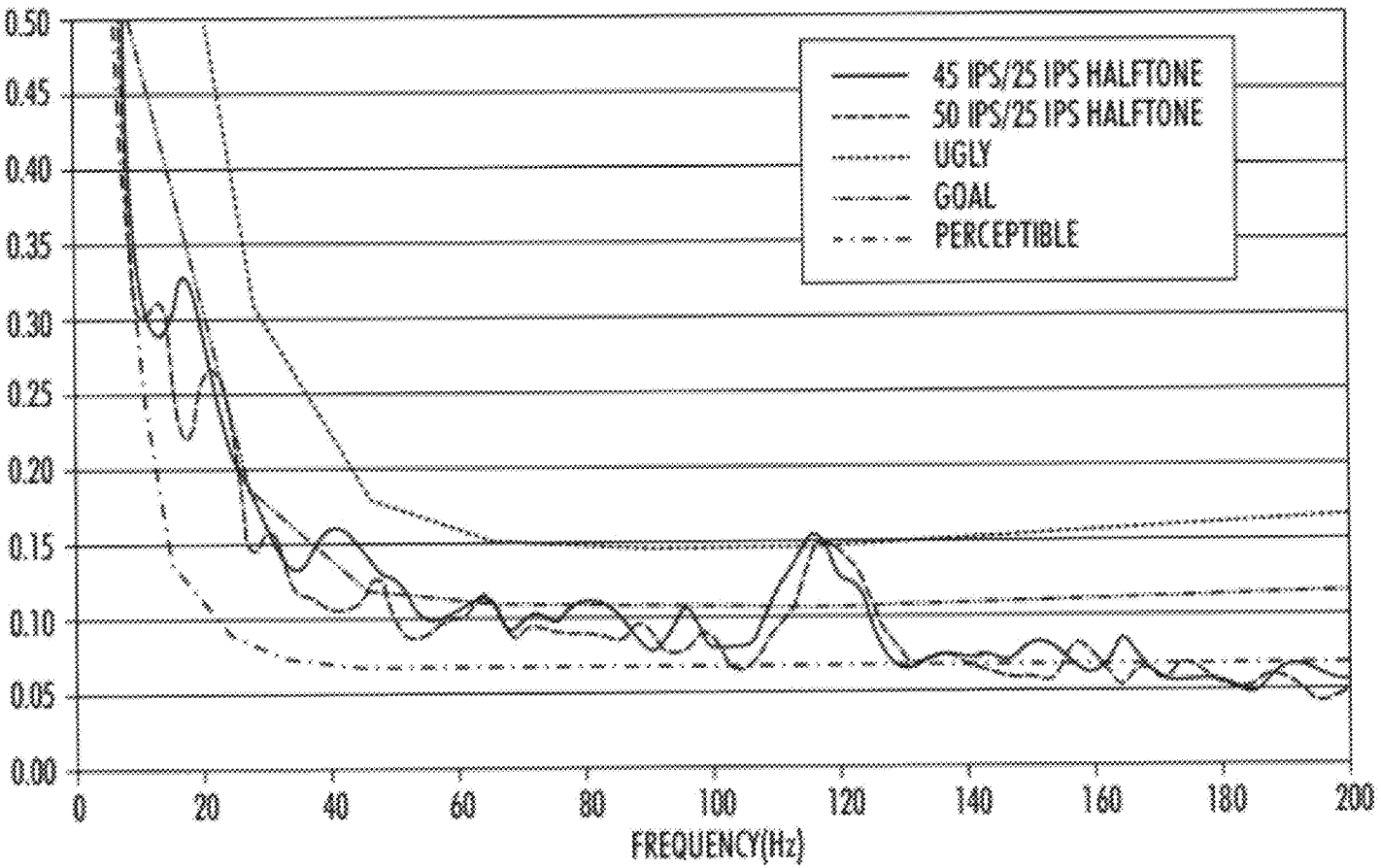
Figure 16:
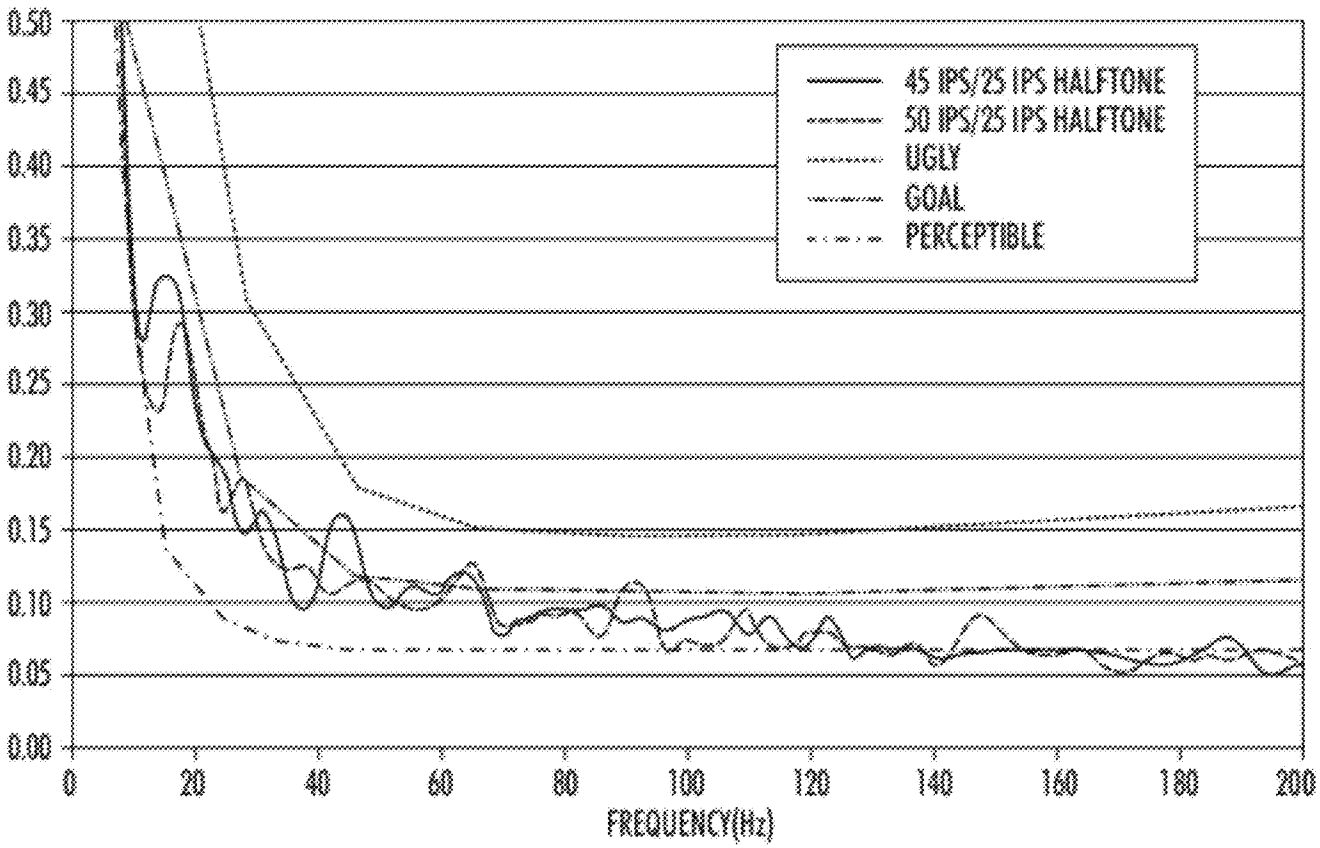

In FIGS. 15 and 16, print scans of a banding metric are shown. The banding metric is the amplitude of density error perpendicular to the process direction, which is referred to as "banding". These banding scans were obtained by optically scanning a full page half tone print, and processing the data with a Fast Fourier Transform (FFT) algorithm. FIG. 15 illustrates a conventional donor roll assembly run at two different mag roll speeds, while FIG. 16 illustrates a donor roll assembly in accordance with the present disclosure, again with data from 2 different mag roll speeds. Frequency is shown on the x-axis, the banding amplitude is shown on the y-axis. The uppermost specification line (ugly) represents a failure level above which print banding defects generally become unacceptable to the customer. In FIG. 15, the conventional donor roll exceeds the unacceptable specification line. As will be appreciated with reference to FIG. 16, the donor roll in accordance with the present disclosure produces results that do not encroach upon or exceed the uppermost specification line.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A donor roll assembly for a developer unit comprising:
- a donor for delivering toner onto a moving photoconductive member, the donor roll supported for rotation and having an input shaft;
- a gear slideably received on the input shaft; and
- a torsion damper for rotationally coupling the gear to the input shaft of the donor roll for torsion damping;
- wherein the torsion damper includes a pin for interlocking the gear with the input shaft, a first portion of the pin being received in a radial bore of the input shaft, and a second portion of the pin being received in a bore of the gear.

2. A donor roll assembly as set forth in claim 1, wherein the torsion damper includes a resilient member at the interface of the gear and input shaft, the resilient member adapted to permit limited relative rotation between the gear and the input shaft.

3. A donor roll assembly as set forth in claim 2, wherein the pin includes a rigid core at least partially surrounded by the resilient member.

4. A donor roll assembly as set forth in claim 3, wherein the rigid core is made of metal.

5. A donor roll assembly as set forth in claim 2, wherein the pin is composed of an elastomer.

6. A donor roll assembly as set forth in claim 1, wherein the pin is rigid, and a resilient member at least partially surrounds the second portion of the pin received in the bore in the gear, respective radial surfaces of the bore adapted to impinge the resilient member for torsion damping.

7. A donor roll assembly as set forth in claim 6, wherein the resilient member includes an o-ring telescoped over an end of the pin.

8. A donor roll assembly as set forth in claim 1, further comprising a motor having an output shaft drivingly connected to said gear for rotating the donor roll.

9. A developer unit including a donor roll assembly as set forth in claim 1.

10. A donor roll assembly for a developer unit comprising:
- a donor for delivering toner onto a moving photoconductive member, the donor roll supported for rotation and having an input shaft;
- a gear slideably received on the input shaft; and
- a torsion damper for rotationally coupling the gear to the input shaft of the donor roll for torsion damping;
- wherein the torsion damper includes a resilient member received in a radial bore in the input shaft, and a rigid pin interlocking the gear and input shaft, a first portion of the rigid pin being supported by the resilient member, and second portion of the pin being received in a bore in the gear.

11. A donor roll assembly as set forth in claim 10, wherein a central portion of the pin is supported by the resilient member, and opposite end portions of the pin are received in respective bores in the gear.

12. A donor roll assembly as set forth in claim 10, wherein the bore in the input shaft is larger in diameter than the bore in the gear, the larger diameter bore in the input shaft adapted to accommodate a generally cylindrical resilient member having a larger diameter than that of the pin.

13. A donor roll assembly as set forth in claim 12, wherein the resilient member and pin are coaxially aligned.

14. A donor roll assembly for a developer unit comprising:

a donor for delivering toner onto a moving photoconductive member, the donor roll supported for rotation and having an input shaft;

a gear slideably received on the input shaft; and a torsion damper for rotationally coupling the gear to the input shaft of the donor roll for torsion damping;

wherein the torsion damper includes at least one elastomer ring interposed between a radially inner surface of the gear and a radially outer surface of the input shaft, the elastomer being compressed between the respective surfaces of the input shaft and gear.

15. A donor roll assembly for a developer unit comprising:

a donor for delivering toner onto a moving photoconductive member, the donor roll supported for rotation and having an input shaft;

a gear slideably received on the input shaft; and a torsion damper for rotationally coupling the gear to the input shaft of the donor roll for torsion damping;

wherein the torsion damper includes a flexible key received in corresponding keyways of the input shaft and gear, and a pin interlocking the gear and input shaft together for rotation, the pin being received in an elongated bore in the gear, the elongated bore permitting limited relative rotation between the gear and the input shaft, said flexible key damping said limited relative movement.

16. A method of reducing speed errors in a driven donor roll of a developer unit, comprising the steps of:

rotationally interlocking a driven gear and to an input shaft of a donor roll using a torsion damper; and driving the donor roll with a motor having an output shaft drivingly connected to the driven gear;

wherein the rotationally interlocking includes installing a pin for interlocking the gear with the input shaft, a first portion of the pin being received in a radial bore of the input shaft, and a second portion of the pin being received in a bore of the gear.

* * * * *